US011484087B2

(12) United States Patent
Kue

(10) Patent No.: US 11,484,087 B2
(45) Date of Patent: Nov. 1, 2022

(54) FOOTWEAR ADAPTED FOR LOCAL ASSEMBLY AND CUSTOMIZATION AND FOR WEARER ADJUSTABILITY

(71) Applicant: Hype Co., Denver, CO (US)

(72) Inventor: Chengkou Kue, Centennial, CO (US)

(73) Assignee: Hype Co., Denver, CO (US)

( * ) Notice: Subject to any disclaimer, the term of this patent is extended or adjusted under 35 U.S.C. 154(b) by 13 days.

(21) Appl. No.: 17/211,485

(22) Filed: Mar. 24, 2021

(65) Prior Publication Data

US 2021/0298408 A1 Sep. 30, 2021

Related U.S. Application Data

(60) Provisional application No. 62/994,663, filed on Mar. 25, 2020.

(51) Int. Cl.
*A43B 3/24* (2006.01)
*A43B 1/00* (2006.01)

(52) U.S. Cl.
CPC ..... *A43B 3/244* (2013.01); *A43B 1/0054* (2013.01); *A43B 1/0081* (2013.01)

(58) Field of Classification Search
CPC ..... A43B 3/244; A43B 3/24; A43B 1/0081; A43B 3/122
USPC ..... 36/11.5, 101, 15
See application file for complete search history.

(56) References Cited

U.S. PATENT DOCUMENTS 2,112,761 A * 3/1938 Buehner ..... A43B 3/122 36/11.5
3,032,896 A * 5/1962 Weaver ..... A43B 1/0027 36/101
4,967,750 A * 11/1990 Cherniak ..... A43C 11/1493 D2/916
9,380,827 B1 * 7/2016 Schoenhaus ..... A43B 7/1445
2002/0194750 A1 * 12/2002 Feick ..... A43C 11/06 36/11.5
2003/0177664 A1 * 9/2003 Monassebian ..... A43B 3/242 150/103
2004/0064976 A1 * 4/2004 Barteet ..... A43B 3/103 36/100
2005/0066550 A1 * 3/2005 Liu ..... A43B 1/0081 36/11.5
2007/0266506 A1 * 11/2007 Barteet ..... A43B 3/103 12/128 R
2008/0000107 A1 * 1/2008 Styles ..... A43B 3/105 36/100
2008/0098626 A1 * 5/2008 Wright ..... A43C 11/24 36/110
2009/0193684 A1 * 8/2009 Diamond ..... A43B 3/122 36/23

(Continued)

*Primary Examiner* — Marie D Bays
(74) *Attorney, Agent, or Firm* — Snell & Wilmer L.L.P.; Kent A. Lembke

(57) ABSTRACT

Design for footwear in the form of a slide that is designed to be made up of several parts or components. All or a subset of these are manufactured by one or more manufacturers and provided to another party for assembly in a location that is "local" to a point of sale. The assembly of the separate or modular parts or components produces a slide that is suitable for sale to and for wear by the purchaser or end user. One or more of the parts or components provided to the assembling party is in the form of a blank that can be modified to provide local customization while other embodiments will have that customized part or component manufactured locally for later assembly. Further, the new design for slides includes one or more features that allow the end user or wearer to adjust the size and fit of each slide.

21 Claims, 3 Drawing Sheets

(56) References Cited

U.S. PATENT DOCUMENTS

| | | | | |
|---|---|---|---|---|
| 2010/0170113 | A1* | 7/2010 | Garza | A43B 3/103 36/136 |
| 2010/0186258 | A1* | 7/2010 | Garza | A43B 23/24 36/11.5 |
| 2012/0311886 | A1* | 12/2012 | Reno, III | A43B 1/0081 36/71 |
| 2013/0185958 | A1* | 7/2013 | McGuire | A43B 3/103 36/101 |
| 2013/0312286 | A1* | 11/2013 | Fralin | A43B 1/0081 36/101 |
| 2014/0196318 | A1* | 7/2014 | Verheem | A43B 3/0078 36/137 |
| 2015/0196093 | A1* | 7/2015 | Knutson | A43B 7/34 36/72 R |
| 2015/0305441 | A1* | 10/2015 | Sebastian | A43B 1/0054 36/100 |
| 2016/0242493 | A1* | 8/2016 | Stillwagon | A43B 3/242 |
| 2016/0374425 | A1* | 12/2016 | Hau | A43C 15/02 36/127 |
| 2017/0224047 | A1* | 8/2017 | Walker | A43B 7/1495 |
| 2018/0184753 | A1* | 7/2018 | Stillwagon | A43B 3/242 |
| 2018/0360159 | A1* | 12/2018 | Lin | A43B 1/02 |
| 2019/0183207 | A1* | 6/2019 | Jackson | A43B 3/122 |
| 2019/0335836 | A1* | 11/2019 | Gao | A43B 3/244 |
| 2020/0008515 | A1* | 1/2020 | Pellegrino | A43B 3/0078 |
| 2021/0127779 | A1* | 5/2021 | Haehn | A43B 3/0078 |
| 2021/0204636 | A1* | 7/2021 | Ray | A43B 3/122 |
| 2022/0132975 | A1* | 5/2022 | Maher | A43B 3/244 36/101 |

* cited by examiner

FOOTWEAR ADAPTED FOR LOCAL ASSEMBLY AND CUSTOMIZATION AND FOR WEARER ADJUSTABILITY

REFERENCE TO RELATED APPLICATIONS

This application claims priority to U.S. Provisional Patent Application No. 62/994,663 filed on Mar. 25, 2020, which is incorporated herein in its entirety by reference.

BACKGROUND

1. Field of the Description

The present description relates, in general, to footwear and its manufacture. More particularly, the present description relates to footwear in the form of a slide-type shoe (or "slide") that is designed in a unique manner to facilitate local assembly and customization and also for adjustability in fit by the end user or wearer of the footwear.

2. Relevant Background

There are many situations in the footwear industry in which it is desirable to provide footwear, such as a slide-type shoe (or, more simply, "a slide"), that is designed to allow an end user or purchaser to be able to adjust its fit or size. This is useful so that footwear or slides with such an adjustable design can be worn by people with a range of shoe sizes but yet provide a comfortable fit while also being tight or snug enough that they remain on the wearer's feet during walking. Also, such a design simplifies manufacture as it avoids the requirement of manufacturing a different article of footwear for each shoe size of a targeted customer pool.

Further, though, there is a demand for footwear, including slides, that is designed to be assembled in the country in which it will later be sold. This is desirable for a number of reasons including marketing as "Made in This Country" as well as to reduce tariffs or duties in many cases.

Still further, many in the footwear industry are demanding footwear designs that are customized for a particular set of customers. For example, it is often desirable for clothing and footwear to be designed to show a wearer's support of a particular university or for a particular sporting team. As another example, a business such as a golf course or a destination resort may wish to sell clothing and footwear that allows purchasers and wearers to show that they are loyal to that business or that they played golf a that course or stayed at that resort.

To date, there has not been a footwear design (such as a design for a slide) that successfully meets all three of these design goals. As a result, there remains a need for a new footwear design that provides footwear or a slide that is adjustable by the end-user or wearer, that is configured to be locally assembled in the country or region of sale and/or distribution, and that is also adapted to be customizable such as with a color(s), a logo(s), and/or a branding component(s) during assembly before sale/distribution or even by the end user or customer after purchase.

SUMMARY

Briefly, a new design is provided by the inventor for footwear or a slide that is specially adapted for local assembly. The slide is designed to be made up of several parts or components, and all (or a subset) of these may be manufactured by one or more manufacturers and provided to another party for assembly in a location that is "local" to a point of sale (e.g., components made in one or two countries and then shipped to another country for assembly). The assembly of the separate or modular parts or components produces a slide (or slide assembly or footwear assembly, herein) that is suitable for sale and for wear by the purchaser or end user.

One or more of the parts or components provided to the assembling party may be provided in the form of a blank that can be modified to provide local customization while other embodiments will utilize or include a customized part or component manufactured locally for later assembly with the parts or components that were not made locally. Further, the new design for slides includes one or more features that allow the end user or wearer to adjust the size and/or fit of each slide to suit the size and shape of their foot.

More particularly, a footwear assembly is provided that is configured for local assembly, customization, and adjustability in size and fit. The assembly includes a midsole and a top strap with an elongated planar body. The assembly also includes an attachment system including a first attachment element supported at a first location on a side of the midsole, a second attachment element supported at a second location on the side of the midsole opposite the first location, a third attachment element provided on an inner surface of the body of the top strap near a first end, and a fourth attachment element provided on the inner surface of the body of the top strap near a second end opposite the first end. A functional piece of footwear is assembled by first coupling the first and third attachment elements together and by second coupling the second and fourth attachment elements together to detachably mount the first and second ends of the body of the top strap to the side of the midsole.

In some implementations, the attachment system includes one of a hook and loop system, snap buttons, one or more magnets and matching ferrous elements, and one or more buckles. Then, the first and third attachment elements and the second and four attachment elements each include differing halves of detachable coupling pairs of the one of the hook and loop system, the snap buttons, the one or more magnets and matching ferrous elements, and the one or more buckles. Further, in some cases, the first and third attachment elements and the second and third attachment elements are configured such that at least one of the detachable coupling pairs is adapted for coupling in two or more positions, whereby a size or a fit of the functional piece of footwear can be set at two or more states.

In these or other implementations of the footwear assembly, the body of the top strap is formed of a flexible material, whereby the body is elastically deformable during assembly of the functional piece of footwear. In such cases, the flexible material is selected from the group consisting of leather, polyurethane, nylon, silicon, rubber, and plastic or other synthetic material. The outer surface of the top strap may include at least one customization element to allow local or end user customizing of the footwear assembly. For comfort, the assembly may further include a liner comprising a compressible and/or elastic body mounted on the inner surface of the body of the top strap.

BRIEF DESCRIPTION OF THE DRAWINGS

FIGS. 2A-2C are schematic illustrations, similar to FIGS. 1A-1C, of a second embodiment of a footwear assembly (or piece of footwear such as a slide) of the present description during three assembly stages.

DETAILED DESCRIPTION

Briefly, embodiments described herein are directed toward footwear, such as a slide (or a footwear assembly or slide assembly), that is configured for local assembly. In this regard, all or portions of the footwear may be manufactured by a first manufacturer and then shipped to another party located in another geographic region or country for local assembly into the footwear that is suitable for sale and use by an end user or wearer. The first manufacturer may provide one or more parts for the final footwear assembly in the form of a blank that can be modified to provide local customization of the footwear. In other embodiments of the present description, the customized component(s) of the footwear assembly is manufactured locally (i.e., in same geographic region or country as the assembling party) by the assembling party or another manufacturer and provided to the assembling party. Further, the new footwear is designed with one or more features that allow its size and/or fit to be adjustable by the end user or wearer.

Figures 1A, 1B, 1C:
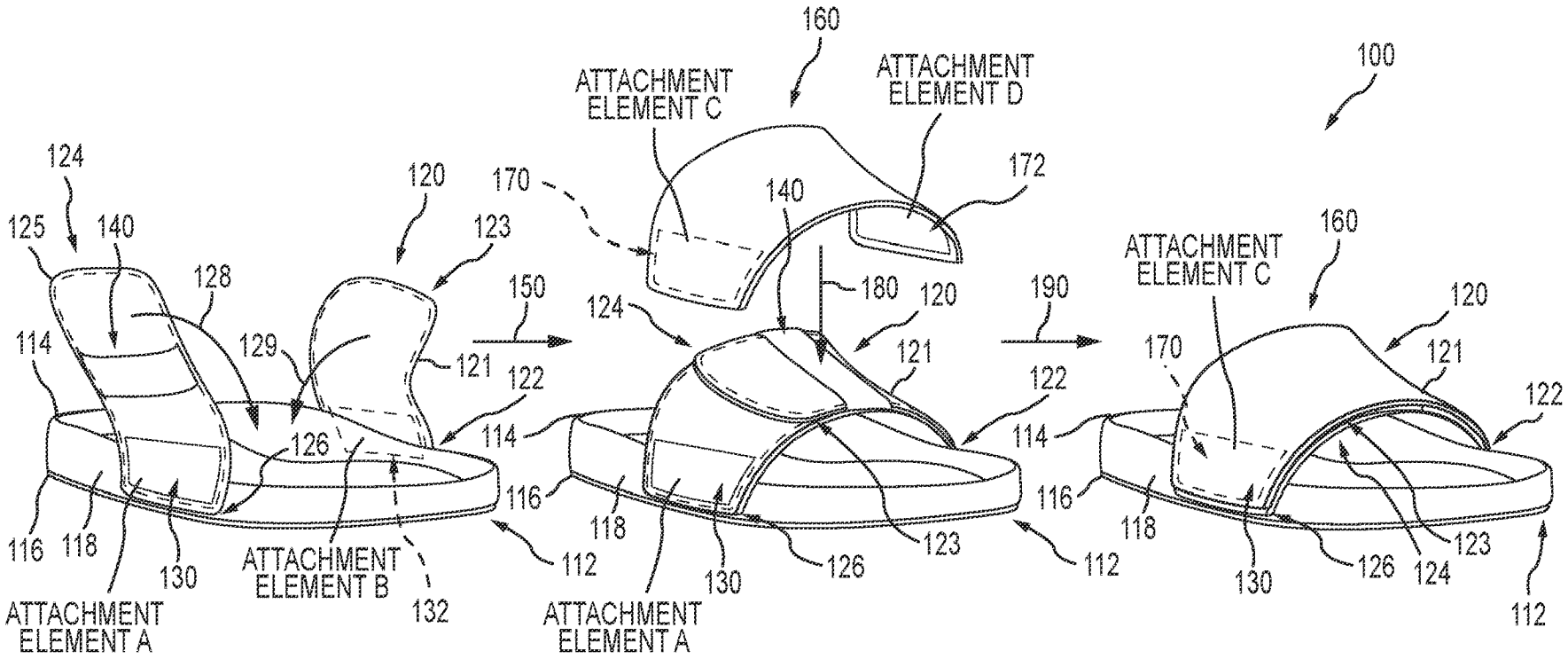
FIGS. 1A-1C provide a schematic illustration of one embodiment of a piece of footwear or a slide (or a footwear or slide assembly) of the present description during three stages of its assembly.

FIGS. 1A-1C provide a schematic illustration of assembly of one embodiment a footwear assembly (or piece of footwear such as a slide) 100 of the present description, with the resulting assembly or slide 100 shown in FIG. 1C. In brief, this design or construction is the combination of two components that can be separately manufactured and then later assembled together at a desired locality prior to sale. As shown, the two components of the slide 100 include a midsole and outsole assembly and a top strap insert 160 that are attached together, as seen with arrow 180 in FIG. 1B, to create as seen with arrow 190 an adjustable piece of footwear or a slide 100 as shown in FIG. 1C. Separated, the components are not functional.

The midsole and outsole assembly includes an outsole 112, which often will be made of a more durable and hard material such as a plastic or hard rubber, and a midsole 114, which may be formed of a material that is softer to be more cushioning such as a compression EVA, a polyurethane (e.g., made via PU injection techniques), cork, and/or synthetic materials. A bottom surface 116 of the midsole 114 is affixed (e.g., via an adhesive or other technique) to the outsole 112 to form the midsole and outsole assembly or base of the footwear assembly or slide 100.

In the midsole and outsole assembly, a pair of wing liners or wings 120, 124 are attached at opposite locations to the side 118 of the midsole 114 (e.g., about halfway along the length of the midsole 114 on left and right edges). The two wing liners (or left and right wings) 120, 124 have bodies (with a width of 1 to 4 inches or the like and a length of 3 to 6 inches or the like) extending, respectfully, from an upper end (see upper end 123 of liner 120) to a lower end 122, 126, which is affixed to the side 118 of the midsole 114. The bodies of the wing liners 120, 124 have an outer surface 121 and 125 that faces away from the midsole 114 upon assembly as shown with arrows 128 and 129. The wing liners 120, 124 may be formed of one or more materials (neoprene, a textile, leather, a synthetic material, and so on) that are chosen such that the wing liners 120, 124 are flexible and soft.

Each wing liner is attached (e.g., via adhesive, stitching, and/or the like) at an outer or lower end 122, 126 to an outer edge or side 118 of the midsole 114. For example, the liners 120, 124 may each be attached, as shown, at a center location along the midsole length or at a location that is some distance forward from center. An inner or upper end (such as end 123 of wing liner 120) is left unattached or free to be moved during assembly shown by arrows 128 and 129. During assembly, the two inner or upper ends of the wing liners 120, 124 are moved into an overlapping position to form (as shown with arrow 150) an assembled midsole and outsole assembly as seen in FIG. 1B.

A stretch webbing (e.g., a nylon strip extending across one of the wings upper or lower surfaces) or other alignment element 140 is provided on the upper or outer surface 125 of one of the wing liners 124 to keep the two overlapping wings 120, 124 as shown in FIG. 1B in a desired position, which is selectable by the end user or wearer to provide an adjustable fit or sizing of the footwear or footwear/slide assembly 100. As shown, the wing liners 120, 124 overlap each other to eliminate discomfort and allow for the top strap insert 160 to be attached during assembly (as shown with arrow 180 in FIG. 1B) and adjusted when desired by the assembler or end user (e.g., placement of the insert 160 contributes to and/or controls the size and fit of the finished footwear assembly or slide 100) to finalize assembly as shown with arrow 190.

The footwear assembly 100 is finally assembled 190 or becomes an assembled system as shown in FIGS. 1B and 1C upon placement (as shown with arrow 180) of the top strap insert 160. At this point, the assembly 100 is a functional piece of footwear for by a wearer as the top strap insert 160 retains the wing liners 120, 124 in their overlapping position shown in FIG. 1B. The insert 160 has a thin and flexible body with an upper or outer surface 162 and a lower or inner surface 164 that faces the midsole 114 upon assembly 180 and abuts the outer or upper surfaces 121, 125 of the two wing liners 120, 124. The top strap insert 160 may be formed of leather, a PU sheet or leather, nylon, silicon, rubber, and/or another synthetic material. It is formed to be sized and shaped to provide full or nearly full coverage to the wing liners 120, 124 as shown in assembly 100 in FIG. 1C.

To apply the top strap insert 160 on the wing liners 120, 124, an attachment system is included in the footwear assembly 100. This attachment system includes a pair of wing components or elements (or attachment element A and attachment element B) 132, 130 affixed to the outer or lower ends 122, 126 and on the outer or uppers surface 121, 125 of the wing liners 120, 124. The attachment system further includes a corresponding pair of components or elements (or attachment element C and attachment element D) 172, 170 mounted or provided on an inner or lower surface 164 (at outer edges or ends so as to be in mating position with elements 132, 130) of the body of the top strap insert 160. FIG. 1A shows that the wing liner attachment elements 130 and 132 are facing outward or are exposed and are located proximate to the liner-to-midsole attachment point on the side 118 of the midsole 114. FIG. 1B shows that the top strap insert attachment elements 170 and 172 are provided on the surface 164 of the insert body that is positioned in abutting contact as shown with arrow 180 with the wing liners 124, 120 during assembly to cause these two pairs of attachment elements (e.g., elements 130 and 170 and elements 132 and 172) to mate (or be linked or coupled) to affix the strap interest 160 to the midsole and outsole assembly as seen in assembled slide 100 in FIG. 1C.

The attachment system may be provided in a wide variety of manners that allows for the two outer ends of the top strap insert's body to be attached to, and later detached from, the lower or outer ends of the two wing liners as shown in FIGS. 1B and 1C. For example, the attachment system may be a hook and loop system (e.g., Velcro®), may include use of snap buttons, may include one or more magnets and matching ferrous elements, may include one or more buckles, and so on, and each pair of attachment elements (such as elements 130 and 170 and elements 132 and 172) would include one half of such attachment techniques (e.g., one would be the hooks and the other the loops in a hook and loop system, one would include the female and the other the male portions of the snap buttons, one would be the magnet and the other ferrous element in a magnetic attachment system, and so on).

This configuration of the midsole and outsole assembly combined with the top strap insert 160 facilitates or enables local assembly of the footwear assembly or slide 100 (e.g., to achieve an assembled system or piece of footwear such as a slide where each of the separate components do not provide functioning footwear (i.e., the midsole and outsole assembly is not useful by itself as footwear)). Further, the attachment system allows for adjustability and comfort with the slide 100 as the amount of overlap of the liners 120, 124 and the mating of the top strap insert 160 with the side 118 of the midsole 114 can be user/wearer selected during assembly (as shown in FIGS. 1A-1C).

In some preferred embodiments, the top strap or top strap insert 160 has a planar or flat body (until assembled with some bending into a curved shape as shown in FIG. 1B). This planar first or "at rest" state of the strap 160 is desirable so that it can be readily embellished with a variety of custom details (e.g., to include at least one customization element) so that the footwear assembly or slide 100 is customizable. For example, a design, one or more colorings or patterns, a logo, and so on may be provided upon the upper or outer surface 162 of the top strap insert 160. This customization (not shown but readily understood by those skilled in the arts) may include screen or digital printing, embroidery, TPU hot melting, high frequency welding, or nearly any other processing of the strap body and/or surface 162.

The top strap insert 160 may be provided with the other components (e.g., with the midsole and outsole assembly) or be manufactured and provided separately (e.g., manufactured by a different party such as a manufacturer local or more local to the assembling party). The top strap insert 160 may be provided in blank form such as with no or single coloring (e.g., white, black, or the like) with no or limited embellishments on upper or outer surface 162. The embellishing may be performed locally by the party assembling the assembled slide or footwear assembly 100 or may be performed by a separate party and then provided to the assembling party for use in assembly as shown in FIGS. 1B and 1C. The top strap insert 160 may also be swapped out by the end user to allow them to create two, three, or more customizable slides 100 using the same midsole and outsole assembly with top straps 160 having different customizations.

Figures 1A, 2B, 2C:
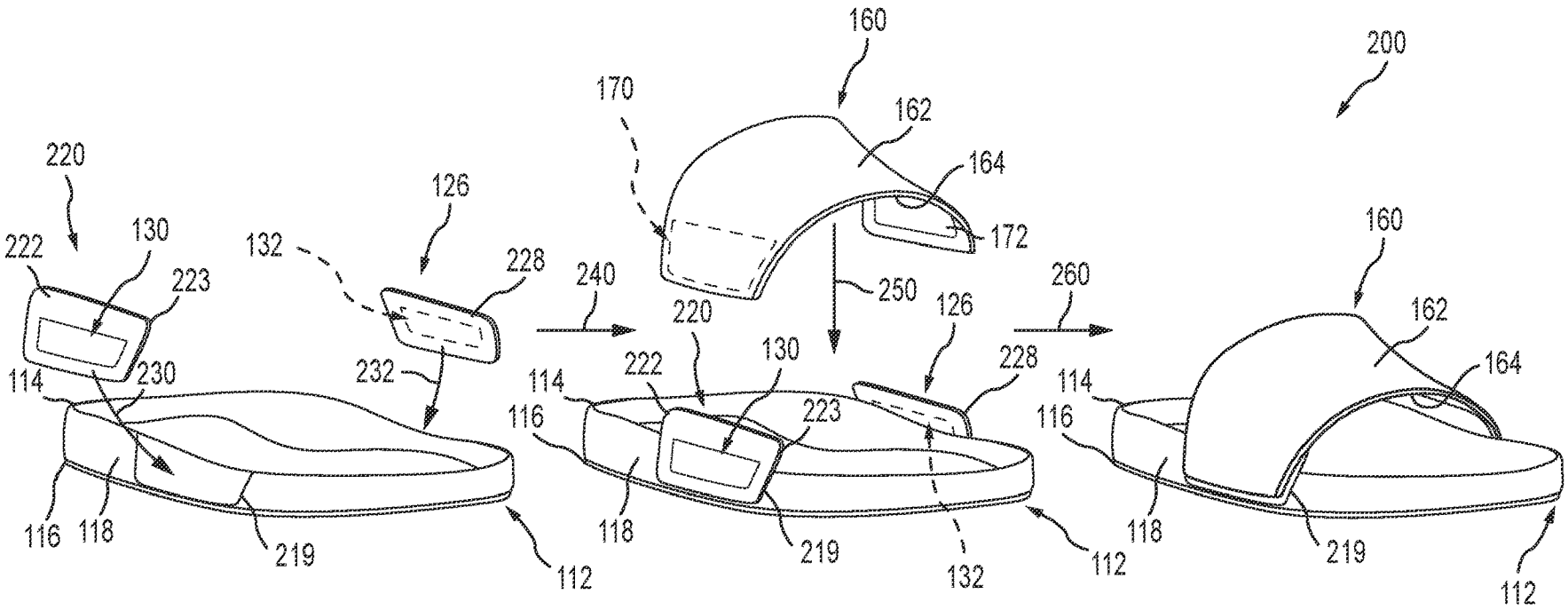

FIGS. 2A-2C provides a schematic illustration, similar to FIGS. 1A-1C, of assembly of a second embodiment of a footwear assembly 200 (or piece of footwear such as a slide) of the present description. Like components found in both sets of figures are provided with like numbers and may not be explained again in detail to avoid repetition and provide ease of explanation.

In this design or option, the midsole and outsole assembly is provided without the wing liners 120, 124. As shown in FIG. 2A, it is instead configured for ready positioning and affixing as shown with arrows 230 and 232 (via adhesive, stitching, or other means) of attachment supports 220 and 226 (each having an outer surface 222, 228 and in inner surface 223, 229, which is placed into abutting contact and affixed to an attachment area of the side 118 of the midsole 114 (as shown with area 219 for receiving and mating with inner surface 223 of the support 220)). The assembled midsole and outsole assembly is then passed as shown with arrow 240 for further assembly stages as shown in FIG. 2B.

On the outer surfaces 222 and 228 of attachment supports 220, 226, the first and second components or elements 130, 132 of the attachment system (which may take the same form or a different form from those provided on the wing liners 120 and 124 in the assembly 100 of FIGS. 1A-1C) are provided. Once the supports 220, 226 are attached to the midsole 114 as shown in FIG. 2A, the attachment elements 130, 132 are properly positioned and supported for later mating with attachment elements 170, 172 on the inner or lower surface 164 of the top strap insert 160 as seen in FIG. 2B upon assembly shown with arrow 250. The positioning of the strap 160 during mating of the pairs of attachment elements (130 and 170, 132 and 172 seen in FIG. 2B) allows the end user to adjust the size and fit of the assembled (as shown with arrow 260) slide 200 shown in FIG. 2C.

Such assembly shown with arrows 230, 232, 240, 250, and 260 may be performed locally by the assembling party (or by a third party in some cases). The top strap insert 160 in this footwear assembly 200 may be identical to that provided in the assembly 100 of FIGS. 1B and 1C or it may, in some preferred cases, be modified to include a pad or liner formed similarly to the bodies of the wing liners of FIGS. 1A and 1B. This construction or design simplifies the attachment system and removes the liner support 118. As shown, portions of the attachment system are directly adhered to the sole (e.g., attachment supports 220, 226 with attachment elements 130, 132 are affixed to the side 118 of midsole 114).

Figure 3A:
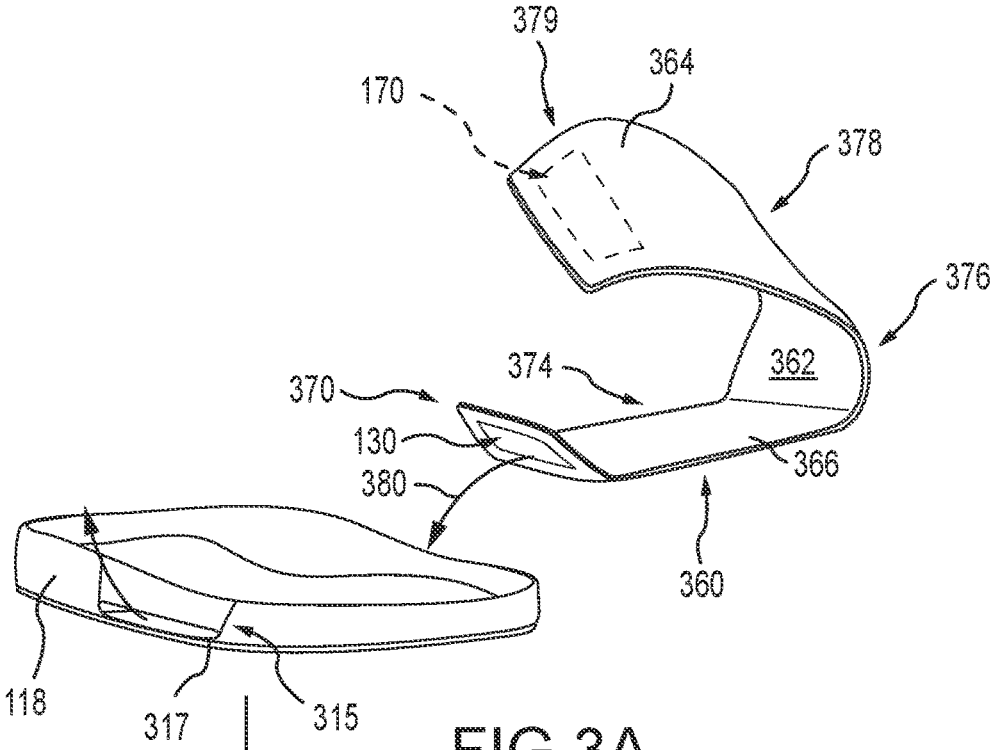
FIGS. 3A-3C is a schematic illustration, similar to FIGS. 1A-2C, during assembly of a third embodiment of a footwear assembly (or piece of footwear such as a slide) of the present description.
Figure 3B:
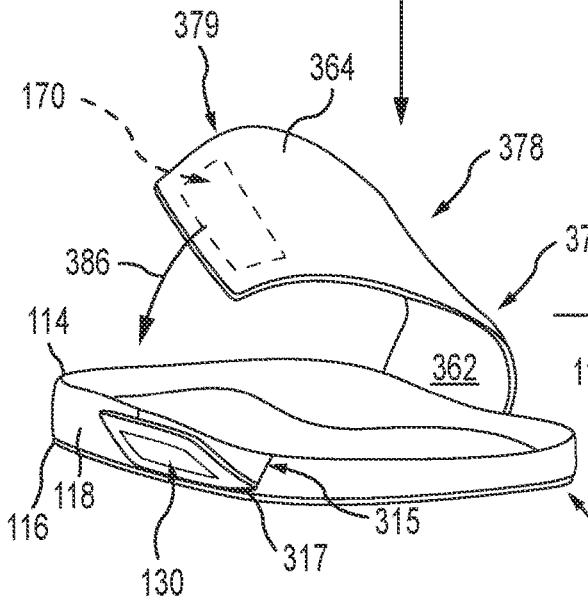
Figure 3C:
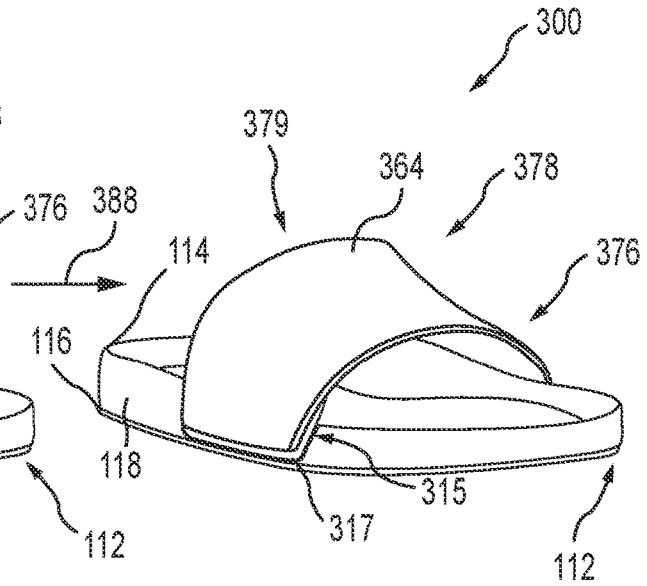

FIGS. 3A-3C provide a schematic illustration, similar to FIGS. 1A and 2C, of the assembly of a third embodiment of a footwear assembly 300 (or piece of footwear such as a slide) of the present description. In this construction or design of the slide 300, the top strap insert 360, as shown in FIG. 3A, is formed so as to provide all components of the attachment system (attachments elements 130 and 170) as well as the padding or liner elements provide by wing liners 120 and 124 in FIG. 1A (with a padded inner surface 366 at least in portions contacting a wearer's foot). In other words, the top strap 360 is the entire assembly that is later coupled with the midsole and outsole assembly to form the assembled footwear assembly or slide 300 shown in FIG. 3C.

The body 362 of the top strap insert 360 extends from a first or lower end 370 to a second or upper end 379, and the body 362 has an outer surface 364 and an inner surface 366. The body 362 is much longer than that used in the designs of FIGS. 1A-2C, and it includes a first end 370, a lower section 374, a side section 376, a top strap section 378, and a second end 379. The body 362 is longer than strap 160 so that it can be inserted through a passageway 317 in a center section or zone 315 of the midsole (e.g., a recessed surface may be formed in a lower surface 116 of the midsole 114 that mates with the upper surface of the outsole 112, with this recessed surface extending from the left to the right edges of the body of the midsole 114 to form the passageway 317) as shown with arrows 380 and 382 until the first or lower end 370 extends outward a distance from the midsole side 118 to expose the first attachment element 130.

The lower section 374 of the strap body 362 is positioned within the passageway 317, and the side section 376 extends upward or orthogonal to the midsole 114. The top strap section 378 can then be moved so as to extend over the midsole 114 to allow the strap 360 to be attached back upon itself via the pair of attachment system elements 130 and 170 provided on opposite ends 370 and 379 of the body 362 of the strap 360 (as well as on opposite sides of the body 362). Particularly, as shown in FIG. 3A, the first attachment element 130 is provided on the outer surface 364 of the body 362 on the first end 370 while the second attachment element 170 with which it pairs or mates, upon the assembly shown with arrows 384 and 386, is provided on the inner surface 366 of the strap body 362 on the second end 379.

This reduces complexity of the construction, but, in the same way as in the designs of FIGS. 1A-2C, each component (i.e., midsole and outsole assembly and top strap 360) is nonfunctional as footwear without each other or prior to assembly into the assembled slide 300. Adjustability is provided in how and/or where the two attachment system elements 130 and 170 are mated together as shown with arrow 386 in FIG. 3B (e.g., with full overlap to provide a tighter fit or smaller slide size up to a minimal overlap to provide a looser fit or larger slide size).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A footwear assembly configured for local assembly, customization, and adjustability in size and fit, comprising:

a midsole with a top surface, a bottom surface, and a side extending between the top and bottom surfaces;

a pair of wing liners each attached at a lower end to the side of the midsole;

a top strap with an elongated planar body; and an attachment system including a first attachment element mounted to an exposed surface of a first one of the wing liners and extending from the lower end of the first one of the wing liners, a second attachment element mounted to an exposed surface of a second one of the wing liners and extending from the lower end of the second one of the wing liners, a third attachment element provided on an inner surface of the body of the top strap to extend inward from a first end, and a fourth attachment element provided on the inner surface of the body of the top strap to extend inward from a second end opposite the first end, wherein the midsole and the pair of the wing liners are not functional as footwear, and wherein a functional piece of footwear is assembled by first coupling the first and third attachment elements together and by second coupling the second and fourth attachment elements together to detachably mount the first and second ends of the body of the top strap to the first and second wing liners at least at first and second locations both on the side of the midsole.

2. The footwear assembly of claim 1, wherein the attachment system comprises one of a hook and loop system, snap buttons, one or more magnets and matching ferrous elements, and one or more buckles.

3. The footwear assembly of claim 2, wherein the first and third attachment elements and the second and fourth attachment elements each comprises differing halves of detachable coupling pairs of the one of the hook and loop system, the snap buttons, the one or more magnets and matching ferrous elements, and the one or more buckles.

4. The footwear assembly of claim 3, wherein the first and third attachment elements and the second and third attachment elements are configured such that at least one of the detachable coupling pairs is adapted for coupling in two or more positions, whereby a size or a fit of the functional piece of footwear can be set at two or more states.

5. The footwear assembly of claim 1, wherein the body of the top strap is formed of a flexible material, whereby the body is elastically deformable during assembly of the functional piece of footwear.

6. The footwear assembly of claim 5, wherein the flexible material is selected from the group consisting of leather, polyurethane, nylon, silicon, rubber, and plastic.

7. The footwear assembly of claim 1, wherein an outer surface of the top strap includes at least one customization element.

8. The footwear assembly of claim 1, wherein the lower end of each of the wing liners is attached to a bottom portion of the side of the midsole distal from the top surface of the midsole.

9. A footwear assembly configured for local assembly, customization, and adjustability in size and fit, comprising:

a midsole;

a pair of wing liners each attached at a lower end to opposite sides of the midsole at locations distal to a top surface of the midsole;

a top strap with an elongated planar body; and an attachment system including a first attachment element mounted at least to the lower end of a first one of the wing liners, a second attachment element mounted at least to the lower end of a second one of the wing liners, a third attachment element provided on an inner surface of the body of the top strap near a first end, and a fourth attachment element provided on the inner surface of the body of the top strap near a second end opposite the first end, wherein the midsole and the pair of wing liners alone are not functional as footwear, and wherein a functional piece of footwear is assembled by arranging the pair of wing liners to have upper ends of the wing liners overlap, by coupling the first and third attachment elements together, and by coupling the second and fourth attachment elements together to detachably mount the first and second ends of the body of the top strap to the side of the midsole.

10. The footwear assembly of claim 9, wherein the attachment system comprises one of a hook and loop system, snap buttons, one or more magnets and matching ferrous elements, and one or more buckles.

11. The footwear assembly of claim 10, wherein the first and third attachment elements and the second and four attachment elements each comprises differing halves of detachable coupling pairs of the one of the hook and loop system, the snap buttons, the one or more magnets and matching ferrous elements, and the one or more buckles.

12. The footwear assembly of claim 11, wherein the first and third attachment elements and the second and third attachment elements are configured such that at least one of the detachable coupling pairs is adapted for coupling in two or more positions, whereby a size or a fit of the functional piece of footwear can be set at two or more states.

13. The footwear assembly of claim 9, wherein the body of the top strap is formed of a flexible material, whereby the body is elastically deformable during assembly of the functional piece of footwear and wherein the flexible material is selected from the group consisting of leather, polyurethane, nylon, silicon, rubber, and plastic.

14. The footwear assembly of claim 9, wherein an outer surface of the top strap includes at least one customization element.

15. A footwear assembly configured for local assembly, customization, and adjustability in size and fit, comprising:

a midsole with a top surface, a bottom surface, and a side extending between the top and bottom surfaces;

a pair of wing liners each attached at a lower end to the side of the midsole at locations spaced apart from the top surface of the midsole;

a top strap with an elongated body; and an attachment system including a first attachment element mounted to an exposed surface of a first one of the wing liners and extending from the lower end of the first one of the wing liners, a second attachment element mounted to an exposed surface of a second one of the wing liners and extending from the lower end of the second one of the wing liners, a third attachment element provided on an inner surface of the body of the top strap at least near a first end and near a second end opposite the first end, wherein the first and third attachment elements and the second and fourth attachment elements each comprises differing halves of detachable coupling pairs, and wherein the first and third attachment elements and the second and third attachment elements are configured such that at least one of the detachable coupling pairs is adapted for coupling in two or more positions on the side of midsole, whereby a size or a fit of the functional piece of footwear can be set at two or more states, the footwear assembly not being functional as a piece of footwear due to a gap between the pair of wing liners until the top strap is coupled to both of the wing liners.

16. The footwear assembly of claim 15, wherein the attachment system comprises one of a hook and loop system, snap buttons, one or more magnets and matching ferrous elements, and one or more buckles.

17. The footwear assembly of claim 16, wherein the differing halves of the detachable coupling pairs each are differing halves of the one of the hook and loop system, the snap buttons, the one or more magnets and matching ferrous elements, and the one or more buckles.

18. The footwear assembly of claim 15, wherein the body of the top strap is formed of a flexible material, whereby the body is elastically deformable during assembly of the functional piece of footwear.

19. The footwear assembly of claim 18, wherein the flexible material is selected from the group consisting of leather, polyurethane, nylon, silicon, rubber, and plastic.

20. The footwear assembly of claim 15, wherein an outer surface of the top strap includes at least one customization element.

21. The footwear assembly of claim 15, wherein the wing liners each comprises a compressible body mounted on the inner surface of the body of the top strap.

* * * * *